US006938904B2

(12) United States Patent
Dalgaard

(10) Patent No.: US 6,938,904 B2
(45) Date of Patent: Sep. 6, 2005

(54) ADJUSTABLE STRAP FOR A BINDING

(75) Inventor: Martin Dalgaard, Topanga, CA (US)

(73) Assignee: Vans, Inc., Santa Fe Springs, CA (US)

( * ) Notice: Subject to any disclaimer, the term of this patent is extended or adjusted under 35 U.S.C. 154(b) by 0 days.

(21) Appl. No.: 10/754,168

(22) Filed: Jan. 9, 2004

(65) Prior Publication Data

US 2004/0145131 A1 Jul. 29, 2004

Related U.S. Application Data

(60) Provisional application No. 60/442,229, filed on Jan. 24, 2003.

(51) Int. Cl.[7] ..... B62B 9/00

(52) U.S. Cl. ..... 280/14.21; 280/14.22; 280/617

(58) Field of Search ..... 280/613, 616, 280/617, 618, 623, 624, 11.3, 11.31, 11.32, 11.33, 14.21, 14.22; 36/117, 56; 24/68 R, 68 SK, 70 SK, 69 SK

(56) References Cited

U.S. PATENT DOCUMENTS

| | | | | | |
|---|---|---|---|---|---|
| 4,683,620 | A | * | 8/1987 | Valsecchi et al. | 24/71 SK |
| D308,997 | S | * | 7/1990 | Katz | D21/773 |
| 5,142,798 | A | * | 9/1992 | Kaufman et al. | 36/117.4 |
| 5,435,080 | A | * | 7/1995 | Meiselman | 36/117.1 |
| 5,609,347 | A | * | 3/1997 | Dressel | 280/14.23 |
| 5,727,797 | A | | 3/1998 | Bowles | 280/14.2 |
| 5,758,895 | A | * | 6/1998 | Bumgarner | 280/607 |
| 5,967,531 | A | | 10/1999 | Saillet | 280/11.36 |
| 6,027,136 | A | | 2/2000 | Phillips | 280/618 |
| 6,056,300 | A | | 5/2000 | Carpenter et al. | 280/14.2 |
| 6,076,848 | A | | 6/2000 | Rigal et al. | 280/634 |
| 6,116,634 | A | * | 9/2000 | Mometti | 280/613 |
| 6,116,635 | A | * | 9/2000 | Rigal | 280/618 |
| 6,224,070 | B1 | | 5/2001 | Carpenter et al. | 280/14.2 |
| 6,250,651 | B1 | * | 6/2001 | Reuss et al. | 280/14.21 |
| 6,283,495 | B1 | | 9/2001 | Phillips | 280/618 |
| 6,293,566 | B1 | * | 9/2001 | Carpenter et al. | 280/14.21 |
| D455,187 | S | * | 4/2002 | Janisch | D21/773 |
| 6,457,736 | B1 | * | 10/2002 | Maravetz et al. | 280/624 |
| 6,520,511 | B2 | * | 2/2003 | Gonthier | 280/11.36 |
| 6,554,295 | B2 | * | 4/2003 | Rittmeyer | 280/11.3 |
| 6,679,515 | B2 | * | 1/2004 | Carrasca | 280/619 |
| 6,679,516 | B2 | * | 1/2004 | Andrevon | 280/623 |
| 6,773,020 | B2 | * | 8/2004 | Gonthier | 280/14.21 |

FOREIGN PATENT DOCUMENTS

| | | | | |
|---|---|---|---|---|
| EP | 0824942 | | 2/1998 | |
| EP | 824942 | A1 * | 2/1998 | A63C/9/08 |

OTHER PUBLICATIONS

US 6,062,576, 5/2000, Carpenter et al. (withdrawn)
US 6,217,040, 4/2001, Carpenter et al. (withdrawn)

* cited by examiner

*Primary Examiner*—Christopher P. Ellis
*Assistant Examiner*—Kelly E Campbell
(74) *Attorney, Agent, or Firm*—Winston & Strawn LLP

(57) ABSTRACT

An adjustable strap assembly for securing a boot to a binding. The assembly includes a lateral strap, an instep pad, a medial strap and an adjustable retention assembly. In an implementation, the lateral strap has a first end for connection to a lateral side of the binding and a second end, and the instep pad includes a connection device positioned on a first distal end for adjustable connection to the second end of the lateral strap. The instep pad also includes an engagement device positioned on a raised ramp area adjacent a second distal end. The medial strap has a first end for connection to a medial side of the binding, and includes an elongated slot along its length that is positioned a predetermined distance from its second end. The adjustable retention assembly is associated with the elongated slot, and functions to releasably secure the medial strap to the instep pad which permits the length of the strap assembly to be selectively adjustable by a user.

16 Claims, 3 Drawing Sheets

ADJUSTABLE STRAP FOR A BINDING

This application claims the benefit of co-pending U.S. Provisional Patent Application No. 60/442,229 filed on Jan. 24, 2003, which is incorporated in its entirety herein.

BACKGROUND ART

The present invention generally relates to a strap arrangement for adjustably securing a boot to a binding. In an embodiment, an instep strap arrangement includes a lateral strap, an instep pad and a medial strap that cooperate to provide an adjustable binding strap that is comfortable and that performs well under a variety of conditions.

Conventional snowboard boot bindings include two or more straps to secure a riders' boot to a snowboard. Snowboard riders demand that their bindings provide high performance, comfort and are convenient to use. A binding system thus must securely attach a boot to the binding, allow the rider to maneuver the board by shifting weight, and be easy to secure and adjust, especially when first entering the binding or when adjusting the binding on a mountain slope during use.

A typical binding strap arrangement includes a toe strap and an ankle strap. The ankle strap may include an instep strap that is adjustably attachable to a mounting strap on one side and a serrated strap on the other side. The mounting strap typically includes an adjustment portion having a plurality of holes for attachment to a sidewall of a baseplate. In order to change the overall length of the ankle strap, an adjustment screw and nut arrangement is unfastened and removed, and then reinserted through a different one of the holes in the mounting strap. This type of binding design restricts adjustability because the number of holes that can be offered along the length of the mounting strap must be limited to minimize the chances of material failure, such as ripping, tearing or otherwise breaking. The opposite side of the instep strap typically includes a ratchet buckle for engaging with the serrated strap, which itself is mounted to the opposite side of the binding. The ratchet buckle is used to tighten the ankle strap over the instep or middle portion of a sports boot.

While such prior art binding strap arrangements have been effective, there is room for improvement. Manufacturers have therefore continued to develop binding strap configurations that provide better performance, comfort and convenience.

SUMMARY OF THE INVENTION

Presented is an adjustable strap assembly for securing a boot to a binding. The assembly includes a lateral strap, an instep pad, a medial strap and an adjustable retention assembly. In an implementation, the lateral strap has a first end for connection to a lateral side of the binding and a second end, and the instep pad includes a connection device positioned on a first distal end for adjustable connection to the second end of the lateral strap. The instep pad also includes an engagement device positioned on a raised ramp area adjacent a second distal end. The medial strap has a first end for connection to a medial side of the binding, and includes an elongated slot along its length that is positioned a predetermined distance from its second end. The adjustable retention assembly is associated with the elongated slot, and functions to releasably secure the medial strap to the instep pad which permits the length of the strap assembly to be selectively adjustable by a user.

In an advantageous embodiment, the engagement device includes a plurality of teeth. In addition, the medial strap includes a plurality of teeth on its lower surface for mating with the teeth of the engagement device. The plurality of teeth of the medial strap may start at the second end of the medial strap and end a predetermined distance from the second end of the medial strap.

In an implementation, the retention assembly comprises a screw and a T-nut. In addition, the retention assembly may include a strap retaining cover. The connection device of the instep pad may be a ratchet buckle mechanism. In an embodiment, the first end of the lateral strap is connected to a lateral sidewall of the binding, and the first end of the medial strap is connected to a medial sidewall of the binding.

Another aspect of the invention concerns a binding assembly for connecting a boot to a snowboard. The binding assembly includes a binding base securable to the snowboard which includes at least a medial sidewall and a lateral sidewall, a toe strap configuration connected on a first side to the lateral sidewall in a toe area of the binding base and on a second side to the medial sidewall in the toe area, and an instep strap assembly. The instep strap assembly includes a lateral strap having a first end for connection to a lateral side of the binding and having a second end, an instep pad that includes a connection device positioned on a first distal end for adjustable connection to the second end of the lateral strap, and having an engagement device positioned on a raised ramp area adjacent a second distal end, a medial strap having a first end for connection to a medial side of the binding and having a second end, the medial strap including an elongated slot along its length that is positioned a predetermined distance from the second end and has a predetermined size, and an adjustable retention assembly. The retention assembly is associated with the elongated slot, and is used to releasably secure the medial strap to the instep pad to permit the length of the instep strap assembly to be selectively adjustable by a user.

In an advantageous embodiment, the first end of the lateral strap is connected to a lateral sidewall of the binding, and the first end of the medial strap is connected to a medial sidewall of the binding. In a variant, the apparatus includes a highback support connected to the binding base. In addition, the first the first end of the lateral strap and the first end of the medial strap may be connected on opposite sides of a highback support heel cup. The retention assembly may include a screw and a T-nut, and may optionally include a strap retaining cover.

In an advantageous embodiment, the toe strap configuration includes a forefoot lateral strap, a forefoot pad, a forefoot medial strap and a forefoot retention assembly. The forefoot pad includes a connection device positioned on a first distal end for adjustable connection to the lateral strap, and an engagement device positioned on a raised ramp area adjacent a second distal end. The forefoot medial strap has a first end for connection to a medial side of the binding and a second end. The forefoot medial strap may include an elongated slot along its length, and the forefoot retention assembly is then associated with the elongated slot. The he forefoot retention assembly may include a screw and a T-nut, and an optional strap retaining cover.

The adjustable strap assembly according to the invention provides an adjustable binding strap that is easy to enter into and exit from, easy for a wearer to adjust, comfortable, and that performs well under a variety of weather and mountain slope conditions.

BRIEF DESCRIPTION OF THE DRAWINGS

Other aspects, purposes and advantages of the invention will become clear after reading the following detailed description with reference to the attached drawings, in which.

Like reference numbers used in the various drawings denote like components and/or features.

DETAILED DESCRIPTION OF THE PREFERRED EMBODIMENTS

Figure 1:
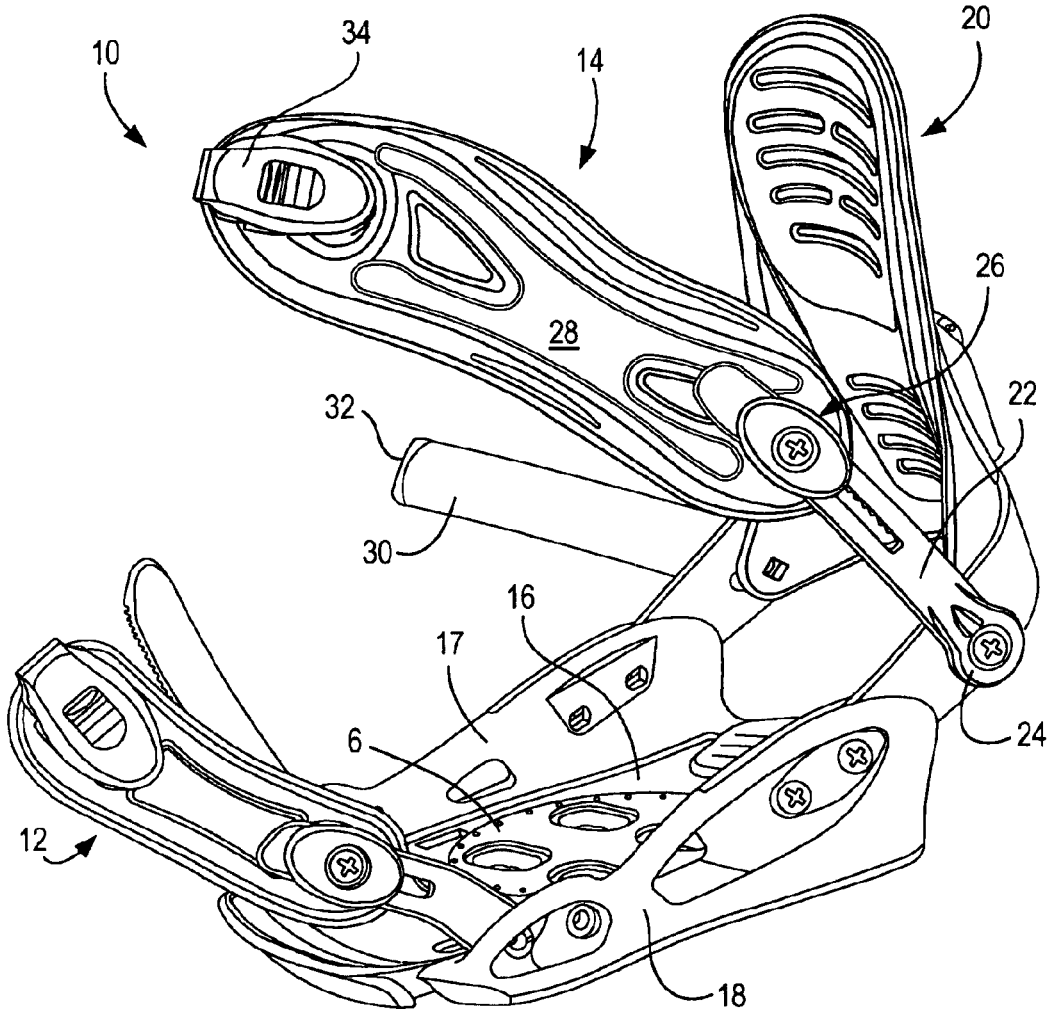
FIG. 1 is a perspective view of a binding for a sports boot that includes adjustable strap configurations according to the invention.

FIG. 1 illustrates a perspective view of a binding assembly 10 that includes a toe strap 12 configuration and an instep strap 14 arrangement according to an implementation of the invention. The strap configurations 12, 14 are shown connected to a binding base 16 in the forefoot region and in a rear area, but could be attached in different locations utilizing any of a number of various attachment means. Such bindings typically include a circular baseplate 6 for attachment to a snowboard or the like, which permits a rider to selectively position the binding base in a particular orientation. The binding arrangement shown in FIG. 1 includes side walls 17, 18 and a highback support 20, but other types of bindings could also be utilized. It should also be understood that for ease of understanding, only a right foot side binding assembly is shown because the left foot side binding assembly is a mirror image thereof.

The instep strap 14 includes a medial strap 22 having a first end 24 for connection to the binding, and a second end 26 for adjustable connection to an instep pad 28. A lateral strap 30 also has a first end for connection to the binding, and a second end 32 for adjustable connection to a connector means 34 that is associated with the instep pad 28. The lateral strap 30 may include a serrated surface (not shown) for releasable connection to the connector device 34 which may be a ratchet buckle. As shown in FIG. 1, the first ends of the lateral strap 30 and the medial strap 22 are connected to a highback heel cup 21 that is associated with the highback support 20. But it should be understood that the lateral and medial straps could be connected to the binding in other locations, such as to the sidewalls 17 and 18.

The instep strap 14 is preferably configured and dimensioned to provide a rider with easy entry to and exit from the strap. The medial strap 22, instep pad 28 and lateral strap 30 cooperate and provide the rider with a comfortable binding strap that performs well under a variety of conditions. The three strap sections are beneficially shaped to conform to the shape of the rider's boot to increase comfort and convenience. Portions of the instep pad 28 section may be made of a leather, plastics or rubber material, and a technique such as injection molding using a curved die could be used to ensure that the straps have contours similar to that of the outside surface of a sports boot. The instep pad may also include padding to provide cushioning and to increase comfort. It should be understood that the instep pad could also be made of other materials, including composite materials, which preferably provide support while still being flexible enough to bend as a rider moves without cracking, splitting or otherwise breaking under various weather and tensioning conditions. The shape and flexible nature of the strap makes it comfortable to use, while still securely engaging the boot of a rider to a snowboard, for example.

Figure 2:
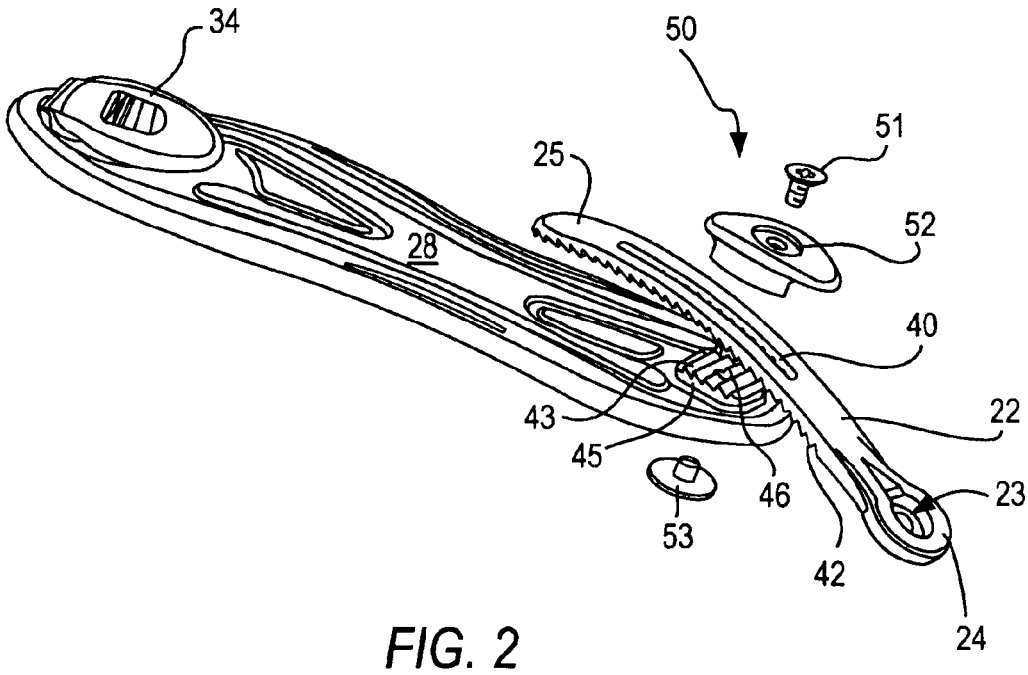
FIG. 2 is a detailed, exploded perspective view of a portion of an instep strap arrangement according to the invention.

FIG. 2 is a detailed, exploded perspective view of the instep pad 28 and medial strap 22 portion of the instep strap 14 shown in FIG. 1. The medial strap 22 includes a first end 24 having a through hole 23 for use in connecting it to a binding (see FIG. 1). The medial strap also includes an elongated slot 40 which begins a predetermined distance from a second end 25 and, in this preferred embodiment, ends past the midway point of the medial strap. The length and position of the elongated slot should be chosen to provide a good range of selectable connection points for a wearer. But care must also be taken to ensure that the medial strap is still strong enough to withstand tension forces and stand up to weather conditions during use without ripping, tearing or otherwise failing.

Referring again to FIG. 2, the medial strap also includes a plurality of strap teeth 42 on its lower surface. In this implementation, the strap teeth 42 are arranged to mate with a teeth engagement means or device 45 that is associated with or affixed to the instep pad 28. The teeth engagement device 45 includes a through hole 46, and may be formed by injection molding, for example, when the instep pad 28 is formed. The engagement device may also be made of other materials, such as a metal, rubber, plastic or composite material, and may be affixed to the pad by, for example, adhesives, rivets or stitching. In a preferred embodiment, a retention assembly 50 that includes a screw 51, a strap retaining cover 52 and a T-nut 53 is used to adjustably secure the medial strap to the instep pad, as explained below.

When a user wishes to select a particular adjustment length for the instep strap 14 as shown in FIG. 1, he threads the screw 51 through the hole in the strap retaining cover 52 which rests in slot 40, and into the through hole 46 in the teeth engagement device 45 so that the screw contacts to cooperate with the T-nut 53. He then tightens the retention assembly 50 by turning screw 51 clockwise so that the strap retaining cover 52 and T-nut 53 will clamp the medial strap 22 and instep pad 28 together, urging the teeth 42 of the medial strap 22 to interlock with the teeth 43 of the engagement device 45. The retention assembly 50 is thus a clamping device for forcing the teeth 42 on the lower surface of the medial strap 22 into engaging contact with the teeth 43 of the engagement device 45, and for retaining the medial strap 22 in a releasably secure manner to the instep pad 28.

Figure 3:
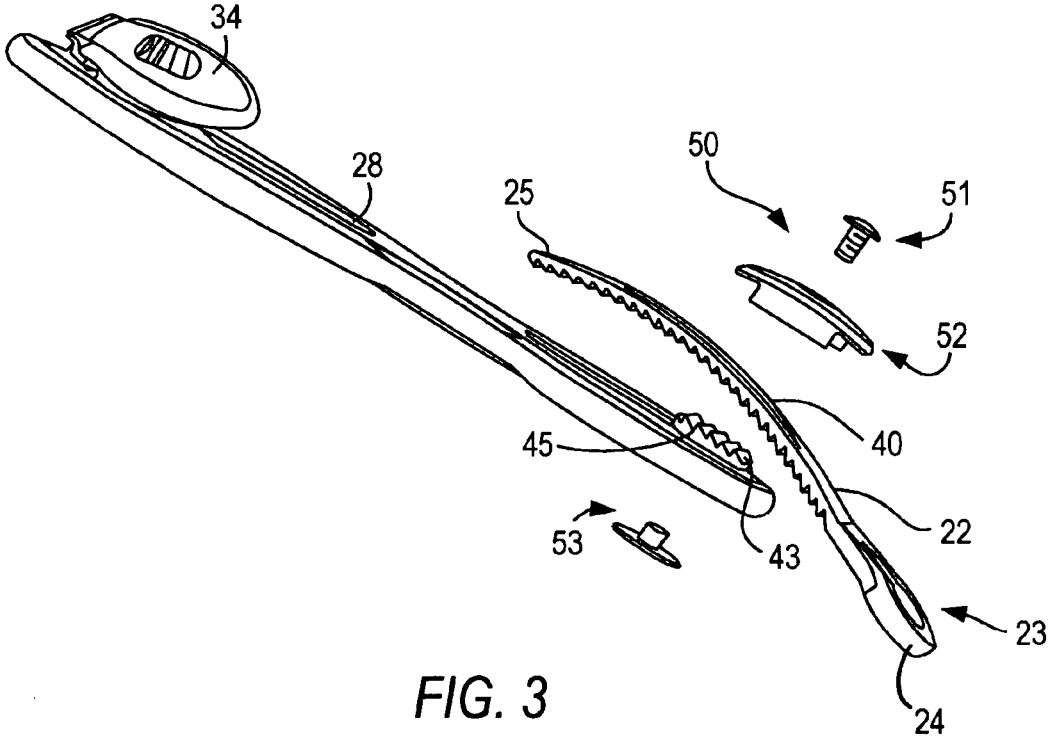
FIG. 3 is an exploded side view of the arrangement of FIG. 2.

FIG. 3 is an exploded side view of the instep strap arrangement of FIG. 2. In particular, the retention assembly 50 including the screw 51, strap retaining cover 52 and T-nut 53 is shown in alignment with the slot 40 of the medial strap 22. FIG. 3 clearly shows how the teeth 42 of the medial strap 22 can be caused to engage with the teeth 43 of the engagement device 45. It should be understood that other types of retention assemblies could be used, such as a quick release mechanism, for urging the teeth of the medial strap 22 to be releasably secured to the teeth 45 of the engagement device 45. It should also be understood that the teeth could be finer or coarser than that shown, and that more or less teeth could be utilized. In addition, other types of retention devices that do not include teeth, including those that may use frictional forces to hold the instep pad and medial strap together, may be used. Furthermore, other binding straps for use with a binding, such as the toe strap 12 shown in FIG. 1, could use the same or similar features as the instep strap arrangement describe herein.

It should also be understood that the exploded views shown in FIGS. 2 and 3 are presented for ease of understanding. In a preferred implementation, the screw 51, retaining member 52 and t-nut 53 are all loosely coupled to the medial strap 22 and/or instep pad 28 so that they will not become separated and perhaps lost when loose or in an untightened state. One of skill in the art would understand how to accomplish such mechanical loosely coupled connections, for example, by incorporating flanges and grooves or shelves within the straps, to retain the various components in either the medial strap or in the instep pad even when they are loosened, such as when a wearer either is putting on, taking off or adjusting the fit of the binding.

The present design beneficially utilizes an adjustment feature located on the raised ramp area of the instep pad 28. Such a design advantageously allows for micro-adjustment and fine positioning of the instep pad by providing the use of a plurality of adjustment teeth. This is achieved by using a medial strap, which contains a single lengthwise slot 40 that may be positioned through the middle portion of the strap. In an implementation, the medial strap incorporates a multitude of horizontally positioned teeth 42 running vertically for the length of the strap including surrounding the slot 42. The teeth 42 are capable of interlocking with the teeth 43 of the retention device 45 which is located on the ramped area of the instep pad 28. The medial strap 22 may be adjusted to the desired location over the raised area on the instep pad, and covered by a strap retaining cover 52, or a washer, or other capping mechanism and then sandwiched together by a screw 51 and T-nut 53. By utilizing a configuration that uses a teeth design, the pressure required of the screw and T-nut is greatly reduced because the mechanical force required to hold both parts together over the surface area of the engaged teeth is reduced. Thus, the connection between the instep pad and medial strap is stronger than that possible with conventional arrangements.

The retention assembly 50, as mentioned above, can incorporate a tool-less adjustment device associated with the instep pad. This is achieved by replacing the screw and T-nut structure with a device that includes the tool-less adjustment feature.

Although a particular implementation has been described, it should be understood that many changes or modifications would be apparent to one skilled in the art that would fall within the scope of the invention.

What is claimed is:

1. An adjustable strap assembly for securing a boot to a binding comprising:

a lateral strap having a first end for connection to a lateral side of the binding and having a second end;

an instep pad that includes a connection device positioned on a first distal end for adjustable connection to the second end of the lateral strap, and having an engagement device that includes a plurality of teeth positioned on a raised ramp area adjacent a second distal end;

a medial strap having a first end for connection to a medial side of the binding and having a second end, the medial strap including an elongated slot along a portion of its length that is positioned a predetermined distance from the second end and having plurality of teeth on a lower surface for mating with the teeth of the engagement device; and an adjustable retention assembly associated with the elongated slot, the retention assembly for releasably securing the medial strap to the instep pad which permits the length of the strap assembly to be selectively adjustable by a user.

2. The apparatus of claim 1 wherein the plurality of teeth of the medial strap begin at the second end of the medial strap and end a predetermined distance from the second end of the medial strap.

3. The apparatus of claim 1 wherein the retention assembly comprises a screw and a T-nut.

4. The apparatus of claim 3 wherein the retention assembly further comprises a strap retaining cover.

5. The apparatus of claim 1 wherein the connection device is a ratchet buckle.

6. The apparatus of claim 1 wherein the first end of the lateral strap is connected to a lateral sidewall of the binding, and wherein the first end of the medial strap is connected to a medial sidewall of the binding.

7. A binding assembly for connecting a boot to a snowboard comprising:

a binding base securable to the snowboard which includes at least a medial sidewall and a lateral sidewall;

a toe strap configuration connected on a first side to the lateral sidewall in a toe area of the binding base and on a second side to the medial sidewall in the toe area; and an instep strap assembly comprising:

a lateral strap having a first end for connection to a lateral side of the binding and having a second end;

an instep pad that includes a connection device positioned on a first distal end for adjustable connection to the second end of the lateral strap, and having an engagement device that includes a plurality of teeth positioned on a raised ramp area adjacent a second distal end;

a medial strap having a first end for connection to a medial side of the binding and having a second end, the medial strap including an elongated slot along its length that is positioned a predetermined distance from the second end and having a plurality of teeth for mating with the teeth of the of the engagement device; and an adjustable retention assembly associated with the elongated slot, the retention assembly for releasably securing the medial strap to the instep pad to permit the length of the instep strap assembly to be selectively adjustable by a user.

8. The apparatus of claim 7 wherein the first end of the lateral strap is connected to a lateral sidewall of the binding, and wherein the first end of the medial strap is connected to a medial sidewall of the binding.

9. The apparatus of claim 7 further comprising a highback support connected to the binding base.

10. The apparatus of claim 9 wherein the first the first end of the lateral strap and the first end of the medial strap are connected on opposite sides of a highback support heel cup.

11. The apparatus of claim 7 wherein the retention assembly comprises a screw and a T-nut.

12. The apparatus of claim 11 wherein the retention assembly further comprises a strap retaining cover.

13. The apparatus of claim 7 wherein the toe strap configuration includes a forefoot lateral strap, a forefoot pad that includes a connection device positioned on a first distal end for adjustable connection to the lateral strap, and having an engagement device positioned on a raised ramp area adjacent a second distal end, a forefoot medial strap having a first end for connection to a medial side of the binding and having a second end, and an adjustable forefoot retention assembly.

14. The apparatus of claim 13 wherein the forefoot medial strap includes an elongated slot along its length, and the forefoot retention assembly is associated with the elongated slot.

15. The apparatus of claim 13 wherein the forefoot retention assembly comprises a screw and a T-nut.

16. The apparatus of claim 15 wherein the forefoot retention assembly further comprises a strap retaining cover.

* * * * *

UNITED STATES PATENT AND TRADEMARK OFFICE

CERTIFICATE OF CORRECTION

PATENT NO. : 6,938,904 B2
DATED : September 6, 2005
INVENTOR(S) : Dalgaard

It is certified that error appears in the above-identified patent and that said Letters Patent is hereby corrected as shown below:

Column 6,
Line 29, after "for mating with the teeth of the" delete "of the"; and
Line 42, after "The apparatus of claim 9 wherein the first" delete "the first".

Signed and Sealed this

Eighth Day of November, 2005

JON W. DUDAS
*Director of the United States Patent and Trademark Office*